US010167623B2

(12) United States Patent
Mou et al.

(10) Patent No.: US 10,167,623 B2
(45) Date of Patent: Jan. 1, 2019

(54) PREFABRICATED REINFORCED CONCRETE-FILLED STEEL PIPE SLEEVE JOINT

(71) Applicants: Ben Mou, Qingdao, Shandong (CN); Chunwei Zhang, Qingdao, Shandong (CN)

(72) Inventors: Ben Mou, Shandong (CN); Chunwei Zhang, Shandong (CN); Xuchuan Lin, Shandong (CN); Xiangyuan Zheng, Shandong (CN); Yongtao Bai, Shandong (CN); Weixing Zhang, Shandong (CN); Dehu Yu, Shandong (CN); Shutong Yang, Shandong (CN)

(73) Assignee: Qingdao University of Technology, Qingdao, Shandong Province (CN)

( * ) Notice: Subject to any disclaimer, the term of this patent is extended or adjusted under 35 U.S.C. 154(b) by 0 days.

(21) Appl. No.: 15/527,010

(22) PCT Filed: Apr. 18, 2016

(86) PCT No.: PCT/CN2016/079531
§ 371 (c)(1),
(2) Date: May 15, 2017

(87) PCT Pub. No.: WO2017/177470
PCT Pub. Date: Oct. 19, 2017

(65) Prior Publication Data

US 2018/0187407 A1 Jul. 5, 2018

(30) Foreign Application Priority Data

Apr. 11, 2016 (CN) ..... 2016 1 0221815

(51) Int. Cl.
*E04B 1/24* (2006.01)
*E04B 1/30* (2006.01)
(Continued)

(52) U.S. Cl.
CPC ..... *E04B 1/2403* (2013.01); *E04B 1/30* (2013.01); *E04B 1/58* (2013.01); *E04B 1/40* (2013.01);
(Continued)

(58) Field of Classification Search
CPC .. E04B 1/2408; E04B 1/30; E04B 2001/2406; E04B 2103/02; E04B 2103/06;
(Continued)

(56) References Cited

U.S. PATENT DOCUMENTS 1,545,456 A * 7/1925 Rastetter ..... E04H 12/08 29/455.1
1,600,032 A * 9/1926 Barrick ..... E04H 12/08 162/181.8
(Continued)

FOREIGN PATENT DOCUMENTS

JP 04330133 A * 11/1992
JP 05263402 A * 10/1993
(Continued)

*Primary Examiner* — Jeanette E Chapman

(57) ABSTRACT

A prefabricated reinforced concrete-filled steel pipe sleeve joint includes high-strength outsourcing steel pipes, reinforcement restraining plates, high-tensile reinforcements, transformation separation sleeves and an ordinary outsourcing steel pipe, wherein: two transformation separation sleeves are respectively located at an upper end and a lower end of the ordinary outsourcing steel pipe; one of the transformation separation sleeves, which is located at the upper end of the ordinary outsourcing steel pipe, is connected with one of the high-strength outsourcing steel pipes; the other transformation separation sleeve, which is located at the lower end of the ordinary outsourcing steel pipe, is connected with the other high-strength outsourcing steel pipe; the high-tensile reinforcements penetrate through the ordinary outsourcing steel pipe; upper ends and lower ends of the high-tensile reinforcements are respectively extended
(Continued)

to interiors of the high-strength outsourcing steel pipes; the high-tensile reinforcements are connected with the transformation separation sleeves.

5 Claims, 5 Drawing Sheets

(51) Int. Cl.
*E04B 1/58* (2006.01)
*E04B 1/41* (2006.01)

(52) U.S. Cl.
CPC . *E04B 2001/2406* (2013.01); *E04B 2001/246* (2013.01); *E04B 2001/2415* (2013.01); *E04B 2001/2418* (2013.01); *E04B 2103/02* (2013.01); *E04B 2103/06* (2013.01)

(58) Field of Classification Search
CPC ..... E04B 2001/246; E04B 2001/2418; E04B 2001/2415; E04B 1/40
See application file for complete search history.

(56) References Cited

U.S. PATENT DOCUMENTS 1,786,631 A * 12/1930 Roe ..... H02G 7/00 174/30
3,473,279 A * 10/1969 Saiko ..... E02D 27/42 52/297
4,910,940 A * 3/1990 Grady, II ..... E04B 1/18 52/223.5
5,218,802 A * 6/1993 Yoshimura ..... E04B 1/215 52/253
5,675,956 A * 10/1997 Nevin ..... E04C 3/34 264/262
8,375,678 B1 * 2/2013 Ferrer ..... E04C 5/165 52/414
8,689,518 B2 * 4/2014 Gridley ..... E02D 27/10 52/167.1
2001/0046415 A1 * 11/2001 Rupiper ..... E02D 27/48 405/232

FOREIGN PATENT DOCUMENTS

KR 2007105454 A * 10/2007
KR 2010063538 A * 6/2010

* cited by examiner

PREFABRICATED REINFORCED CONCRETE-FILLED STEEL PIPE SLEEVE JOINT

CROSS REFERENCE OF RELATED APPLICATION

This is a U.S. National Stage under 35 U.S.C. 371 of the International Application PCT/CN2016/079531, filed Apr. 18, 2016, which claims priority under 35 U.S.C. 119(a-d) to CN 201610221815.1, filed Apr. 11, 2016.

BACKGROUND OF THE PRESENT INVENTION

Field of Invention

The present invention relates to a prefabricated reinforced concrete-filled steel pipe sleeve joint and an installation method thereof, which belongs to the technical field of structural engineering.

Description of Related Arts

With the development of the technology, the high-strength steel has been applied to high-rise buildings and large-span architectures. For the composite structure such as reinforced concrete or steel reinforced concrete which is respectively formed by high tensile reinforcements or high-strength structural steels, once the deformation is too large, the concrete, which is combined with the high tensile reinforcements or high-strength structural steels, will be cracked and broken; and then the reinforcements or structural steels will be locally buckled, which leads to the structural damage. However, for the outsourcing concrete-filled steel tubular column made from high-strength materials, the outsourcing steel pipe and the in-fill concrete are high in integrity; and due to the interaction between the outsourcing steel pipe and the in-fill concrete (the ultimate strain of the in-fill concrete is increased and the local buckling of the outsourcing steel pipe is limited), thereby significantly improving the bearing capacity and the deformation ability of the outsourcing concrete-filled steel pipe which is made from high-strength materials. The elastic deformation ability of the outsourcing concrete-filled steel pipe joints with outer stiffening ring which is made from high-strength steels is 2-4 times than that of the outsourcing concrete-filled steel pipe joints with outer stiffening ring which is made from ordinary steels.

Generally, the high-strength steels on the welding quality requirements and the welding technical difficulty are much higher than the ordinary steels. In the practical engineering, the welding between the steel pipes is often completed at the construction site, which causes that the welding quality of the welds are affected by the construction environment and the technical level of operating personnel on site, thus it is unable to fully guarantee the quality of welding. Furthermore, due to site welding links in the construction, the construction time is prolonged but the project cost is increased.

SUMMARY OF THE PRESENT INVENTION

An object of the present invention is to overcome the foregoing defects of prior arts and provide a prefabricated reinforced concrete-filled steel pipe sleeve joint and an installation method thereof, which is capable of greatly reducing the impact of the site construction on quality, and is much higher in reliability of the joint.

The present invention is achieved by a technical solution as follows. A prefabricated reinforced concrete-filled steel pipe sleeve joint comprises high-strength outsourcing steel pipes, reinforcement restraining plates, high-tensile reinforcements, transformation separation sleeves and an ordinary outsourcing steel pipe, wherein: two transformation separation sleeves are respectively located at an upper end and a lower end of the ordinary outsourcing steel pipe; one of the transformation separation sleeves, which is located at the upper end of the ordinary outsourcing steel pipe, is connected with one of the high-strength outsourcing steel pipes; the other transformation separation sleeve, which is located at the lower end of the ordinary outsourcing steel pipe, is connected with the other high-strength outsourcing steel pipe; the high-tensile reinforcements penetrate through the ordinary outsourcing steel pipe; upper ends and lower ends of the high-tensile reinforcements are respectively extended to interiors of the high-strength outsourcing steel pipes; the high-tensile reinforcements are connected with the transformation separation sleeves; the upper ends and the lower ends of the high-tensile reinforcements are respectively connected with the reinforcement restraining plates.

Preferably, the high-tensile reinforcements are threaded rods.

Preferably, each of the transformation separation sleeves comprises a plate; a through-hole is provided in a center of the plate; vertical baffles are respectively located at two sides of the plate; multiple holes are provided between the vertical baffles and the through-hole for allowing the high-tensile reinforcements to pass through; the high-tensile reinforcements are fixed with the transformation separation sleeves through high-strength bolts; the ordinary outsourcing steel pipe and the high-strength outsourcing steel pipes are respectively inserted into the vertical baffles of the transformation separation sleeves.

Preferably, metal sheets are located at an inner side of an end portion of the ordinary outsourcing steel pipe and the high-strength outsourcing steel pipes.

Preferably, the upper ends and the lower ends of the high-tensile reinforcements are connected with the reinforcement restraining plates through the high-strength bolts.

Preferably, an outer stiffening ring is welded to an exterior of the ordinary outsourcing steel pipe and is connected with a steel beam by means of welding or bolting.

Preferably, fiber concrete is poured into the ordinary outsourcing steel pipe and the high-strength outsourcing steel pipes.

A method for installing a prefabricated reinforced concrete-filled steel pipe sleeve joint comprises steps of:

(1) welding an outer stiffening ring to an exterior of an ordinary outsourcing steel pipe;

(2) respectively connecting transformation separation sleeves with an upper end and a lower end of the ordinary outsourcing steel pipe through high-tensile reinforcements and fastening the transformation separation sleeves through high-strength bolts;

(3) respectively installing reinforcement restraining plates at upper ends and lower ends of high-tensile reinforcements and fastening the reinforcement restraining plates through the high-strength bolts;

(4) connecting one of the high-strength outsourcing steel pipes with the lower end of the ordinary outsourcing steel pipe;

(5) connecting a steel beam with an outer stiffening ring;

(6) connecting the upper end of the ordinary outsourcing steel pipe with the other high-strength outsourcing steel pipe; and (7) pouring fiber concrete into the ordinary outsourcing steel pipe and the high-strength outsourcing steel pipes.

Beneficial effects of the present invention are as follows.

The joint provided by the present invention is able to avoid the site welding among the high-strength outsourcing steel pipes and improve the reliability of the joint. An upper side and a lower side of the joint are respectively connected with an upper steel pipe and a lower steel pipe through the transformation separation sleeve, thereby effectively resolving the problem that concrete-filled steel tubular column is difficult in variable cross section. The steel parts of the whole joint are manufactured by factories, and assembled on site, and then the concrete is poured on site, for minimizing the impact of site construction on quality; the construction of the joint provided by the present invention is convenient and simple; the fiber concrete is beneficial to improve the shear capacity of the concrete, thereby enhancing the shear capacity of the whole joint.

Figure 1:
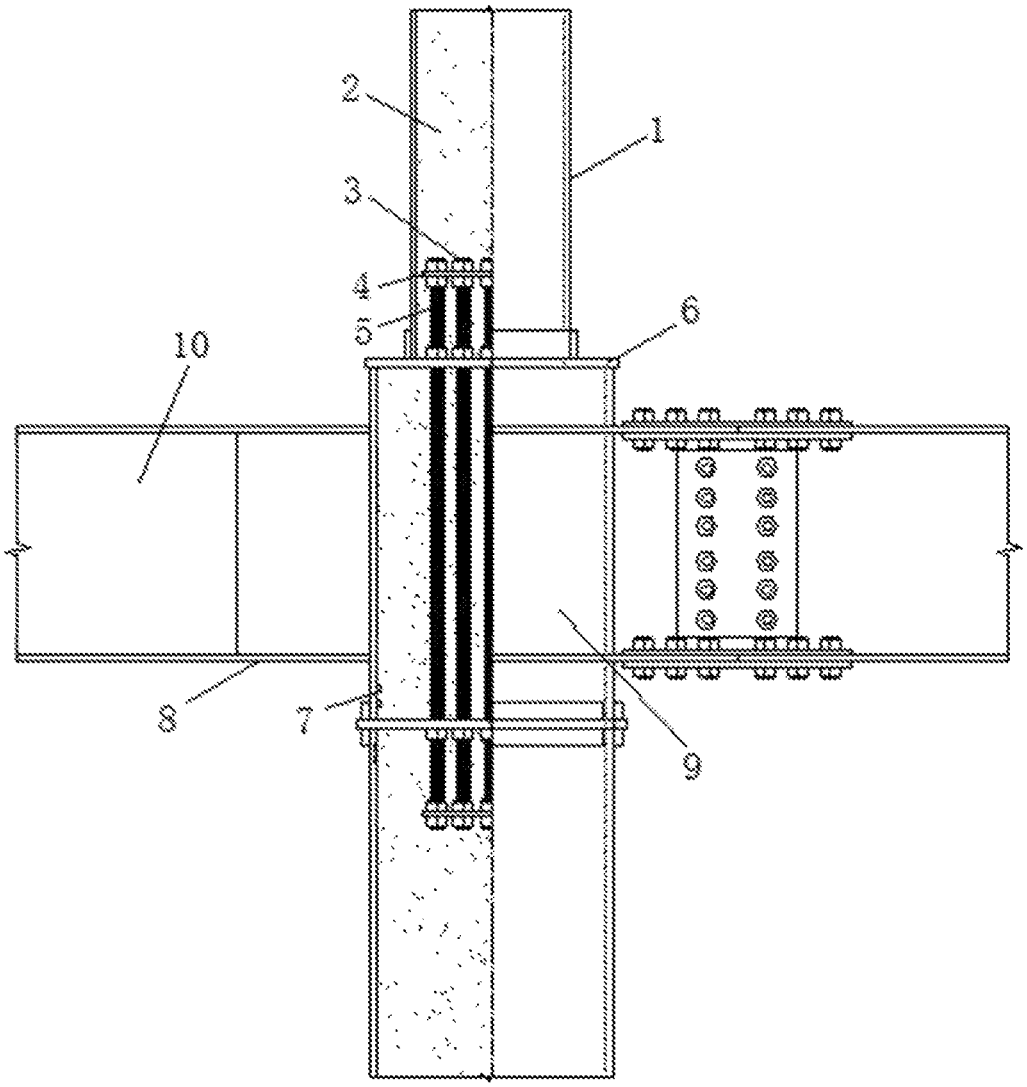
FIG. 1 is an elevation view when a round steel pipe is adopted in the present invention.

In the drawings, 1: high-strength outsourcing round steel pipe; 2: fiber concrete; 3: high-strength bolt; 4: round reinforcement restraining plate; 5: high-tensile reinforcement; 6: round transformation separation sleeve; 7: metal sheet; 8: outer stiffening ring; 9: ordinary outsourcing round steel pipe; 10: steel beam; 11: vertical baffle; 12: bolt connection part; 13: square reinforcement restraining plate.

DETAILED DESCRIPTION OF THE PREFERRED EMBODIMENT

The present invention is further explained with accompanying drawings as follows.

First Embodiment

As shown in FIG. 1, a prefabricated reinforced concrete-filled steel pipe sleeve joint comprises high-strength outsourcing steel pipes, reinforcement restraining plates, high-tensile reinforcements 5, transformation separation sleeves and an ordinary outsourcing steel pipe. In the first embodiment, the high-strength outsourcing steel pipes, the reinforcement restraining plates, the transformation separation sleeves and the ordinary outsourcing steel pipe are respectively high-strength outsourcing round steel pipes 1, round reinforcement restraining plates 4, round transformation separation sleeves 6 and an ordinary outsourcing round steel pipe 9. Two round transformation separation sleeves 6 are respectively located at an upper end and a lower end of the ordinary outsourcing round steel pipe 9. One of the round transformation separation sleeves 6, which is located at the upper end of the ordinary outsourcing round steel pipe 9, is connected with one of the high-strength outsourcing round steel pipes 1; the other round transformation separation sleeve 6, which is located at the lower end of the ordinary outsourcing round steel pipe 9, is connected with the other high-strength outsourcing round steel pipe 1. The high-tensile reinforcements 5 penetrate through the whole ordinary outsourcing round steel pipe 9. Upper ends and lower ends of the high-tensile reinforcements 5 are respectively extended to interiors of the high-strength outsourcing round steel pipes 1. The high-tensile reinforcements 5 are connected with the round transformation separation sleeves 6. The upper ends and the lower ends of the high-tensile reinforcements 5 are respectively connected with the round reinforcement restraining plates 4. The high-tensile reinforcements 5 are threaded rods.

Figure 2:
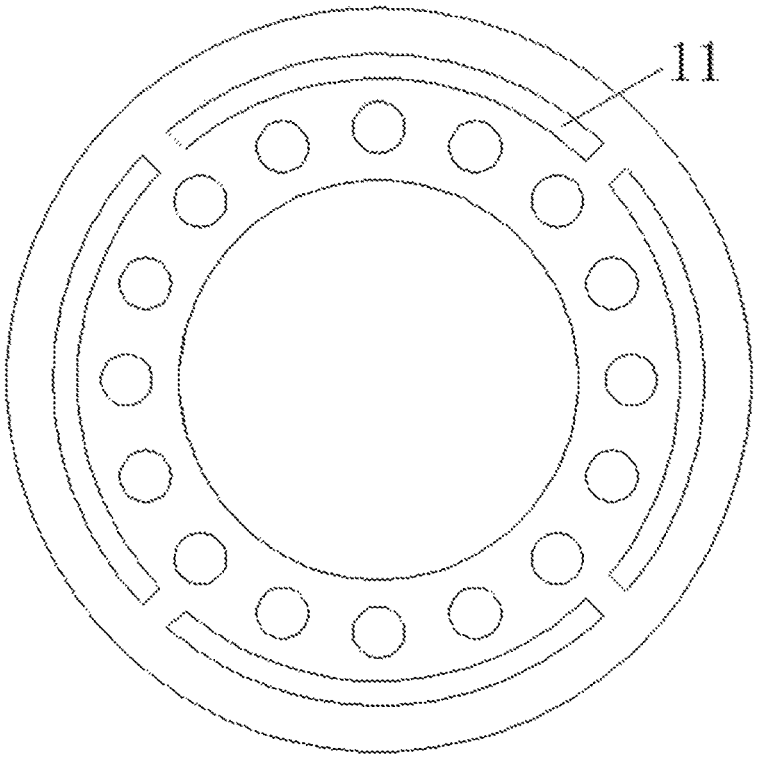
FIG. 2 is a top view of a round transformation separation sleeve.
Figure 3:
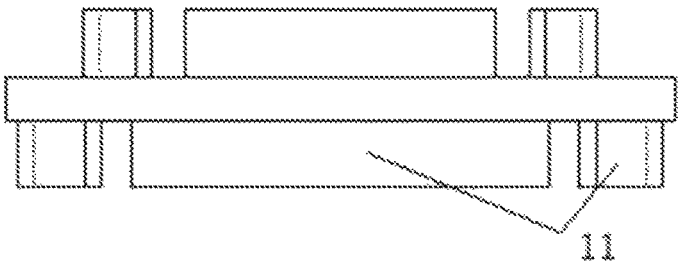
FIG. 3 is a front view of the round transformation separation sleeve.

As shown in FIGS. 2 and 3, each of the round transformation separation sleeves 6 comprises a round plate; a through-hole is provided in a center of the round plate, that is, a round hole is provided in a center of each of the round transformation separation sleeves 6 to convenient for pouring concrete; vertical baffles 11 are respectively located at two sides of the round plate; multiple holes are provided between the vertical baffles 11 and the through-hole for allowing the high-tensile reinforcements 5 to pass through; the high-tensile reinforcements 5 are fixed with the round transformation separation sleeves 6 through high-strength bolts 3, that is, the round transformation separation sleeves 6 are respectively fixed at two ends of the ordinary outsourcing round steel pipe 9 through the high-strength bolts 3.

Each of the vertical baffles on the round transformation separation sleeve is a cylindrical baffle, as shown in FIGS. 2 and 3, the cylindrical baffle is non-continuous, which is convenient for welding the vertical baffles with the round plate. Referring to FIG. 1, the cylindrically vertical baffles, which are respectively located at an upper side and a lower side of one of the round transformation separation sleeves located at the lower end of the ordinary outsourcing round steel pipe 9, are same in diameter, such that the ordinary outsourcing round steel pipe 9 and one of the high-strength outsourcing round steel pipes 1 which is located at the lower end of the lower end of the ordinary outsourcing round steel pipe 9 are same in diameter. However, the cylindrically vertical baffles, which are respectively located at an upper side and a lower side of the other round transformation separation sleeve located at the upper end of the ordinary outsourcing round steel pipe 9, are different in diameter, that is, a diameter of one cylindrically vertical baffle located at the upper side of the other round transformation separation sleeve is smaller than that of another cylindrically vertical baffle located at the lower side of the other round transformation separation sleeve, such that a diameter of one of the high-strength outsourcing round steel pipes 1 which is located at the upper end of the ordinary outsourcing round steel pipe 9 is smaller than that of the ordinary outsourcing round steel pipe 9, which effectively resolves the technical problem that the concrete-filled steel tubular column is difficult in variable cross section to rationalize the structure of the whole steel column, reduce the dead-weight of the entire structure and strengthen the load-bearing capacity.

Figure 4:
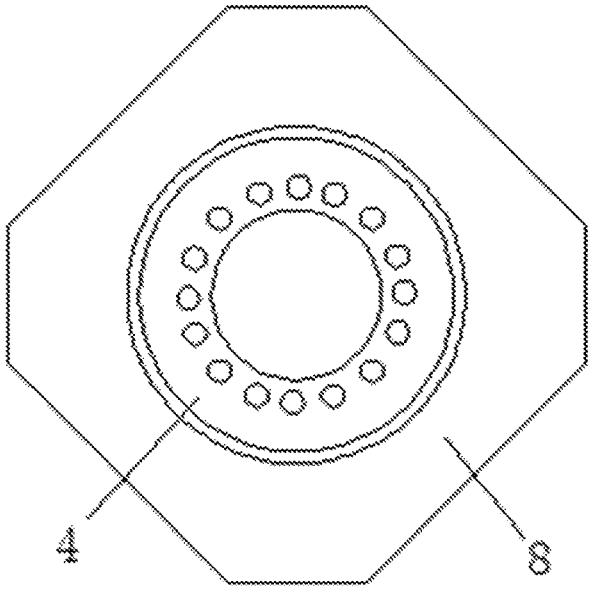
FIG. 4 is planar graph of an outer stiffening ring when the round steel pipe is adopted in the present invention.

As shown in FIG. 1, the upper ends and the lower ends of the high-tensile reinforcements 5 are connected with the round reinforcement restraining plates 4 through the high-strength bolts 3, that is, the round reinforcement restraining plates 4 are clamped at corresponding positions through the high-strength bolts 3. An outer stiffening ring 8 is welded to an exterior of the ordinary outsourcing round steel pipe 9 and is connected with a steel beam 10 by means of welding or bolting, and preferably, is an octagonal outer stiffening ring, as shown in FIG. 4. Fiber concrete 2 is poured into the ordinary outsourcing round steel pipe 9 and the high-strength outsourcing round steel pipes 1. Here, it should be noted that the welding effect of the ordinary outsourcing round steel pipe 9 and the outer stiffening ring 8 is stronger than the welding effect of the high-strength outsourcing round steel pipes 1 and the outer stiffening ring 8, and the ordinary outsourcing round steel pipe is lower in cost. Traditionally, the outer stiffening ring 8 is directly welded with the high-strength outsourcing round steel pipes 1, which is poor in welding effect and instable in structure.

Figure 5:
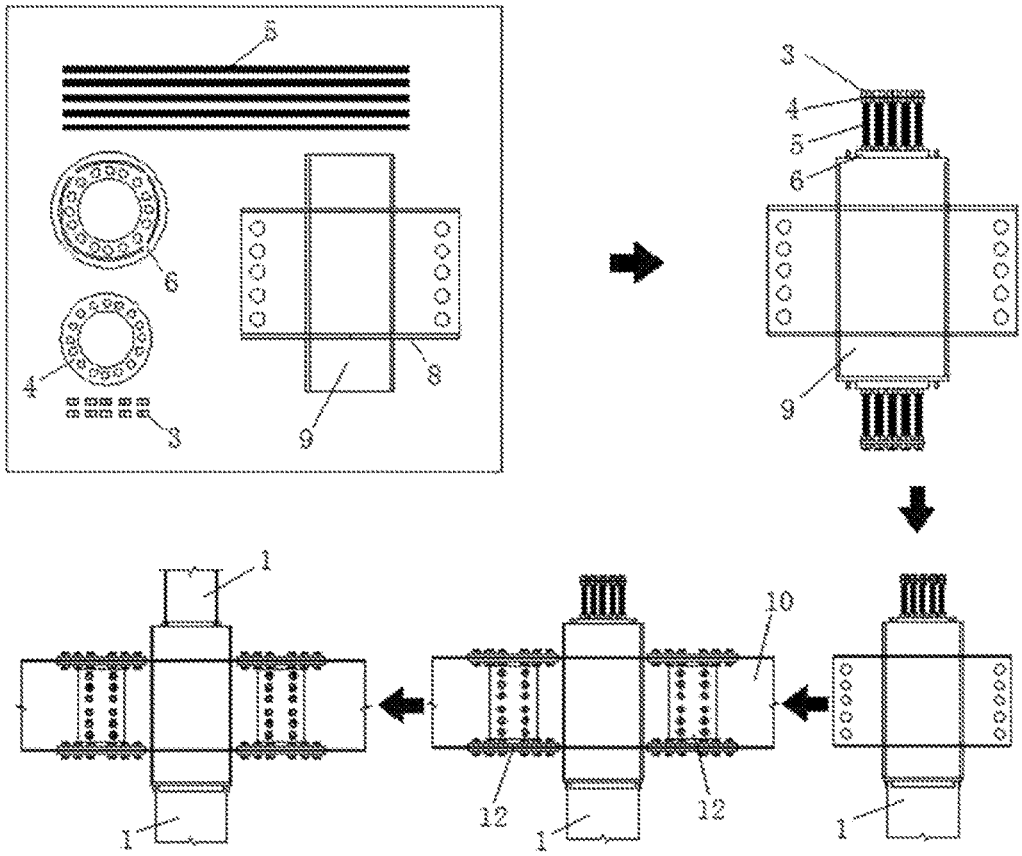
FIG. 5 is an installation flow diagram of the present invention.

Referring to FIG. 5, a method for installing a prefabricated reinforced concrete-filled steel pipe sleeve joint comprises steps of:

(1) welding the outer stiffening ring 8 to the exterior of the ordinary outsourcing round steel pipe 9;

(2) respectively connecting the round transformation separation sleeves 6 with the upper end and the lower end of the ordinary outsourcing round steel pipe 9 through the high-tensile reinforcements 5 and fastening the round transformation separation sleeves 6 through the high-strength bolts 3;

(3) respectively installing the round reinforcement restraining plates 4 at the upper ends and the lower ends of the high-tensile reinforcements 5 and fastening the round reinforcement restraining plates 4 through the high-strength bolts 3;

(4) connecting one of the high-strength outsourcing round steel pipes 1 with the lower end of the ordinary outsourcing round steel pipe 9, that is, inserting the high-strength outsourcing round steel pipe which is located at a lower side of the joint into one of the round transformation separation sleeves located at the lower side of the joint;

(5) connecting the steel beam 10 with the outer stiffening ring 8 by bolting or welding, wherein a bolt connection portion 12 is shown in FIG. 5;

(6) connecting the upper end of the ordinary outsourcing round steel pipe 9 with the other high-strength outsourcing round steel pipe 1, that is, inserting the high-strength outsourcing round steel pipe which is located at an upper side of the joint into the other round transformation separation sleeve located at the upper side of the joint; and (7) pouring the fiber concrete 2 into the ordinary outsourcing round steel pipe 9 and the high-strength outsourcing round steel pipes 1.

In the present invention, the high-tensile reinforcements penetrate through the joint area and are embedded into the upper and lower steel pipe columns which are connected with the joint, for avoiding the site welding among the round steel pipes, so as to improve the reliability of the joint; the upper and lower sides of the joint are respectively connected with the upper and lower steel pipes through the round transformation separation sleeves for effectively resolving the technical problem that the concrete-filled steel pipe is difficult in variable cross section; the steel part of the whole joint is manufactured by factories, and assembled on site, and then the concrete is poured on site, for minimizing the impact of site construction on quality; the fiber concrete is beneficial to improve the shear capacity of the concrete, thereby enhancing the shear capacity of the whole joint.

Second Embodiment

Different from the first embodiment, the prefabricated reinforced concrete-filled steel pipe sleeve joint according to the second embodiment has characteristics as follows. As shown in FIG. 1, a circle of metal sheets 7 are welded on the inner wall of the steel pipe 9; before installing, the metal sheets are preprocessed to improve the bite force between the steel pipe and the concrete.

Other structures of the prefabricated reinforced concrete-filled steel pipe sleeve joint according to the second embodiment are same as the first embodiment.

Third Embodiment

Different from the first embodiment, the prefabricated reinforced concrete-filled steel pipe sleeve joint according to the third embodiment has characteristics as follows. Both the vertical baffles at the upper side and the lower side of every round transformation separation sleeve are a continuous cylindrical sleeve and form a one-piece structure with the round plate, so that the whole round transformation separation sleeve is more stable and reliable in structure, and is more reliable in the connection with the steel pipe.

Other structures of the prefabricated reinforced concrete-filled steel pipe sleeve joint according to the third embodiment are same as the first embodiment.

Fourth Embodiment

Figure 6:
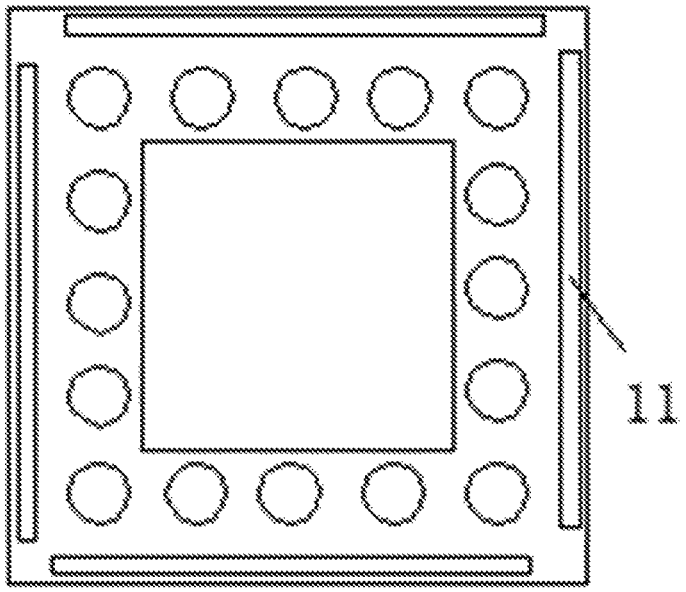
FIG. 6 is a top view of a square transformation separation sleeve.
Figure 7:
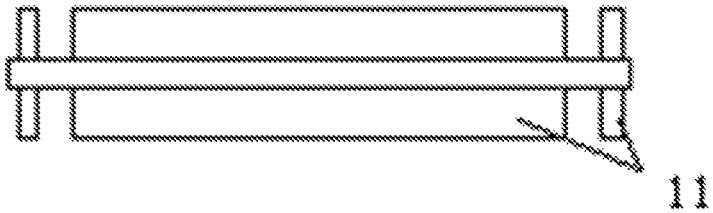
FIG. 7 is a front view of the square transformation separation sleeve.
Figure 8:
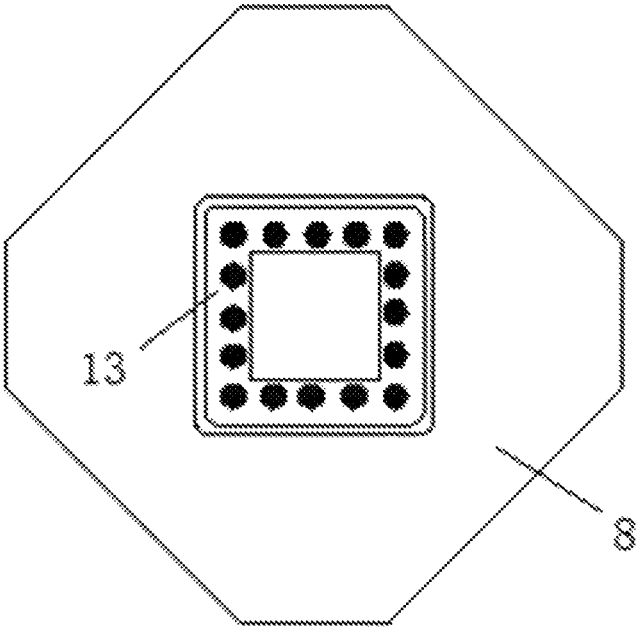
FIG. 8 is planar graph of an outer stiffening ring when the square steel pipe is adopted in the present invention.

Different from the first embodiment, the prefabricated reinforced concrete-filled steel pipe sleeve joint according to the third embodiment has characteristics as follows. The high-strength outsourcing steel pipes, the reinforcement restraining plates, the transformation separation sleeves and the ordinary outsourcing steel pipe are respectively high-strength outsourcing square steel pipes, square reinforcement restraining plates 13, square transformation separation sleeves and the ordinary outsourcing square steel pipe 9. Referring to FIGS. 6 and 7, the square transformation separation sleeves and the vertical baffles 11 located on the square transformation separation sleeves are illustrated. As shown in FIG. 7, a square defined by the upper vertical baffles 11 has a same dimension with a square defined by the lower vertical baffles 11; as long as the dimensions of the two squares are adjusted to be different from each other, the variable cross section is able to be achieved. FIG. 8 shows a preferred structure of the outer stiffening ring.

Other structures of the prefabricated reinforced concrete-filled steel pipe sleeve joint according to the fourth embodiment are same as the first embodiment.

Fifth Embodiment

In the prefabricated reinforced concrete-filled steel pipe sleeve joint according to the first embodiment and the fourth embodiment of the present invention, the high-strength outsourcing steel pipes, the reinforcement restraining plates, the transformation separation sleeves and the ordinary outsourcing steel pipe are respectively round and square. Different from the first embodiment and the fourth embodiment, the prefabricated reinforced concrete-filled steel pipe sleeve joint according to the fifth embodiment has characteristics as follows. The high-strength outsourcing steel pipes, the reinforcement restraining plates, the transformation separation sleeves and the ordinary outsourcing steel pipe are able to be oval, rectangular and regularly polygonal.

Other structures of the prefabricated reinforced concrete-filled steel pipe sleeve joint according to the fifth embodiment are same as the first embodiment.

Of course, the foregoing contents are merely preferred embodiments of the present invention and are not to be construed as limiting the scope of the embodiments of the present invention. The present invention is not limited to the above-described examples, and includes all variations and modifications encompassed within the spirit and scope of the following claims.

What is claimed is:

1. A prefabricated reinforced concrete-filled steel pipe sleeve joint, comprising: high-strength outsourcing steel pipes, reinforcement restraining plates, high-tensile reinforcements, transformation separation sleeves and an ordinary outsourcing steel pipe, wherein:

two transformation separation sleeves are respectively located at an upper end and a lower end of the ordinary outsourcing steel pipe; one of the transformation separation sleeves, which is located at the upper end of the ordinary outsourcing steel pipe, is connected with one of the high-strength outsourcing steel pipes; the other transformation separation sleeve, which is located at the lower end of the ordinary outsourcing steel pipe, is connected with the other high-strength outsourcing steel pipe; the high-tensile reinforcements penetrate through the ordinary outsourcing steel pipe; upper ends and lower ends of the high-tensile reinforcements are respectively extended to interiors of the high-strength outsourcing steel pipes; the high-tensile reinforcements are connected with the transformation separation sleeves; the upper ends and the lower ends of the high-tensile reinforcements are respectively connected with the reinforcement restraining plates;

an outer stiffening ring is welded to an exterior of the ordinary outsourcing steel pipe and is connected with a steel beam by means of welding or bolting.

2. The prefabricated reinforced concrete-filled steel pipe sleeve joint, as recited in claim 1, wherein fiber concrete is poured into the ordinary outsourcing steel pipe and the high-strength outsourcing steel pipes.

3. The prefabricated reinforced concrete-filled steel pipe sleeve joint, as recited in claim 1, wherein the high-tensile reinforcements are threaded rods.

4. The prefabricated reinforced concrete-filled steel pipe sleeve joint, as recited in claim 2, wherein the high-tensile reinforcements are threaded rods.

5. A method for installing a prefabricated reinforced concrete-filled steel pipe sleeve joint comprising high-strength outsourcing steel pipes, reinforcement restraining plates, high-tensile reinforcements (5), transformation separation sleeves and an ordinary outsourcing steel pipe, wherein: two transformation separation sleeves are respectively located at an upper end and a lower end of the ordinary outsourcing steel pipe; one of the transformation separation sleeves, which is located at the upper end of the ordinary outsourcing steel pipe, is connected with one of the high-strength outsourcing steel pipes; the other transformation separation sleeve, which is located at the lower end of the ordinary outsourcing steel pipe, is connected with the other high-strength outsourcing steel pipe; the high-tensile reinforcements (5) penetrate through the ordinary outsourcing steel pipe; upper ends and lower ends of the high-tensile reinforcements (5) are respectively extended to interiors of the high-strength outsourcing steel pipes; the high-tensile reinforcements (5) are connected with the transformation separation sleeves; the upper ends and the lower ends of the high-tensile reinforcements (5) are respectively connected with the reinforcement restraining plates;

the method comprising steps of:

(1) welding an outer stiffening ring (8) to an exterior of the ordinary outsourcing steel pipe;

(2) respectively connecting the transformation separation sleeves with the upper end and the lower end of the ordinary outsourcing steel pipe through the high-tensile reinforcements (5) and fastening the transformation separation sleeves through high-strength bolts (3);

(3) respectively installing the reinforcement restraining plates at the upper ends and the lower ends of the high-tensile reinforcements (5) and fastening the reinforcement restraining plates through the high-strength bolts (3);

(4) connecting one of the high-strength outsourcing steel pipes with the lower end of the ordinary outsourcing steel pipe;

(5) connecting a steel beam (10) with the outer stiffening ring (8);

(6) connecting the upper end of the ordinary outsourcing steel pipe with the other high-strength outsourcing steel pipe; and (7) pouring a fiber concrete (2) into the ordinary outsourcing steel pipe and the high-strength outsourcing steel pipes.

* * * * *